US006978902B2

(12) United States Patent
Loch

(10) Patent No.: US 6,978,902 B2
(45) Date of Patent: Dec. 27, 2005

(54) SKATEBOARD SECURITY RACK

(75) Inventor: Curt Robert Loch, Upland, CA (US)

(73) Assignee: Curt Loch, Upland, CA (US)

( * ) Notice: Subject to any disclaimer, the term of this patent is extended or adjusted under 35 U.S.C. 154(b) by 0 days.

(21) Appl. No.: 10/614,140

(22) Filed: Jul. 7, 2003

(65) Prior Publication Data

US 2004/0182797 A1 Sep. 23, 2004

Related U.S. Application Data

(60) Provisional application No. 60/456,018, filed on Mar. 19, 2003.

(51) Int. Cl.[7] ..... A47F 7/00; E05B 73/00

(52) U.S. Cl. ..... 211/5; 211/20; 211/22; 211/85.7

(58) Field of Search ..... 211/5, 85.7, 19, 211/20, 22, 24, 70.5, 71.01, 4, 60.1, 17; 70/14, 70/18

(56) References Cited

U.S. PATENT DOCUMENTS 3,785,500 A * 1/1974 Kennelly ..... 211/5
3,786,928 A * 1/1974 Johnson ..... 211/5
3,970,196 A * 7/1976 Legge ..... 211/5
4,027,798 A * 6/1977 Swaim ..... 211/4
4,306,660 A * 12/1981 Livingston ..... 211/20
4,433,787 A * 2/1984 Cook et al. ..... 211/5
4,465,196 A * 8/1984 Erb ..... 211/19
4,474,116 A * 10/1984 Castenada et al. ..... 109/51
4,591,127 A * 5/1986 Tuvesson ..... 248/551
4,773,239 A 9/1988 Lowe et al.
4,807,453 A * 2/1989 Bernier et al. ..... 70/233
5,096,068 A * 3/1992 Theriault ..... 211/22
5,238,125 A * 8/1993 Smith ..... 211/5
D342,637 S 12/1993 Smith
5,301,818 A 4/1994 Dix
5,305,897 A 4/1994 Smith
5,316,155 A * 5/1994 Collins et al. ..... 211/70.5
D354,872 S 1/1995 Dix
5,472,101 A * 12/1995 Ahrens ..... 211/70.5
5,706,680 A 1/1998 Wroble
5,833,079 A 11/1998 Roberts (Continued)

*Primary Examiner*—Jennifer E. Novosad
(74) *Attorney, Agent, or Firm*—Guy Cumberbatch

(57) ABSTRACT

An skateboard security rack having a pair of support members defining a slot therebetween for receiving the deck of a skateboard. At least one of the support members has a width smaller than the wheelbase of the skateboard received in the slot. Locking structure between the support members and across the top of the slot retains the skateboard within the slot. The locking structure may be separate elements coupled to each of the support members and a lock therebetween. Alternatively, the locking structure may be a lock such as a conventional U-shape lock. If separate elements coupled to each of the support members are used, they may be fixed in place, or movable such as longitudinally slideable along the support members. The support members may be elongated hollow or solid members, or formed in panels. The support members are desirably hollow tubes bent into inverted U-shapes. Bases of the support members may be mounted to a variety of base surfaces such as flat or curvilinear, horizontal or vertical. For instance, the bases may be bolt mounted to or embedded in a horizontal concrete sidewalk. Multiple support members can be mounted in sequence to provide an array of slots. The bases of a number of the support members can be shared or connected to provide modular structures that facilitate installation.

12 Claims, 3 Drawing Sheets

U.S. PATENT DOCUMENTS

| | | | | |
|---|---|---|---|---|
| 5,901,588 | A | 5/1999 | Frost | |
| D425,745 | S | 5/2000 | Harris et al. | |
| 6,167,735 | B1 * | 1/2001 | Brown | 70/19 |
| 6,223,907 | B1 * | 5/2001 | Graber | 211/5 |
| 6,230,526 | B1 | 5/2001 | Fontes et al. | |
| 6,257,419 | B1 * | 7/2001 | Kamysiak | 211/22 |
| 6,263,709 | B1 * | 7/2001 | Kemery et al. | 70/14 |
| 6,293,412 | B1 | 9/2001 | Draper et al. | |
| 6,336,562 | B1 * | 1/2002 | Mori | 211/20 |
| 6,481,581 | B2 | 11/2002 | Sipe | |
| 2002/0030025 | A1 | 3/2002 | Spie | |
| 2002/0060194 | A1 | 5/2002 | Reiser et al. | |
| 2002/0144962 | A1 | 10/2002 | Dettorre et al. | |
| 2003/0010735 | A1 | 1/2003 | Wuerth | |

* cited by examiner

SKATEBOARD SECURITY RACK

RELATED APPLICATION

The present application claims priority under 35 U.S.C §119(e) to provisional application No. 60/456,018, filed on Mar. 19, 2003, under the same title.

FIELD OF THE INVENTION

The present invention relates to a convenient, simple, readily accessible means to secure "board type" equipment when left unattended in public areas.

BACKGROUND OF THE INVENTION

Individuals that utilize "board type" equipment (such as skateboards, scooters, snowboards, surfboards, etc.) as a mode of transportation and/or for recreational purposes need a convenient, simple, readily accessible method available to secure their equipment when left unattended in public areas. Riders of skateboard and scooter types of equipment make up the largest population of potential users that will be able to take advantage of the apparatus of the present invention. Literally hundreds of thousands of kids, and some adults, use skateboards as a practical, cost effective, and compact method of transportation daily. Common destinations of skateboard users in this demographic are learning institutions, places of employment, retail areas, and various other public areas including community centers, libraries, and parks. If one rides a bicycle, which in many cases is more expensive and less compact than a skateboard, our society provides many more equipment, structures, and opportunities to secure the bicycle than the skateboard.

There is thus a need for a security lock for "board type" equipment, in particular skateboards. Some attempts have been made to address this need, for example U.S. patent application Publication Ser. No. 03/0010735, filed Jul. 12, 2001 to Wuerth, discloses a skateboard storage apparatus. For various reasons this design and others have not been accepted in the marketplace, and there remains a need for a more cost effective, durable, safe, and elegant design.

SUMMARY OF THE INVENTION

In accordance with the present invention, a skateboard security rack is provided including a pair of spaced apart support members each having a base adapted to mount to a base surface and a portion that extends normally away from the base to a height dimension at least as great as the largest deck width of any skateboard which the security rack is designed to secure. One of the support members has a maximum width dimension smaller than the smallest wheelbase of any skateboard which the security rack is designed to secure. The support members are adapted to mount in parallel to one another at a distance apart that is greater than the largest deck thickness of any skateboard which the security rack is designed to secure. A slot for receiving a deck of a skateboard is defined between the support members. The security rack may be provided with locking structure coupled to both support members for constraining a skateboard in the slot.

The locking structure may include elements coupled to both support members. For example, the elements may comprise loops coupled to both support members wherein a lock may be used to join the loops, and therefore the support members, together. The loops may be movable on at least one of the support members, and may slide freely thereon. Alternatively, the loops may be fixed on each respective support member. Rather than separate elements coupled to both support members and a separate lock, only a lock may be used coupled to both support members.

The support members may be formed as elongated hollow or solid members, or hollow or solid panels. In one preferred embodiment, the support members are configured as elongated upside-down U-bends. The base of the support members may be adapted to bolt to the base surface, or the base may be adapted to be embedded in the base surface.

Another aspect of the invention is a skateboard security rack comprising a first and second support members each having a base adapted to mount to a base surface and a portion that extends normally away from the base to a height dimension at least as great as the largest deck width of any skateboard which the security rack is designed to secure. The two support members have width dimensions that are different, the first support member has a width dimension that is smaller than the smallest wheelbase of any skateboard which the security rack is designed to secure. The two support members are mounted in parallel to a distance apart that is greater than the largest deck thickness of any skateboard which the security rack is designed to secure, a slot therefore being defined between the first and second support members for receiving the skateboard.

A third support member identical to the first support member may be provided which is adapted to mount parallel to the second support member and on the side thereof opposite the first support member. The third support member is mounted a distance from second support member that is greater than the largest thickness of any skateboard which the security rack is designed to secure creating an additional slot between the second and third support members for receiving another skateboard. The bases of the first and third support members may be common, or connected to a common base. In one embodiment, the bases of the first, second, and third support members are common, or connected. In an alternative embodiment, at least one other support member identical to the first and third support members is provided mounted to their common base, and at least one other support member identical to the second support member and mounted to its base is provided.

Desirably, the first and second support members are formed as elongated, inverted U-shapes each having spaced apart ends and an elongated middle portion therebetween. A ring slideable on each of the first and second support members may also be provided for locking a skateboard within the slot with the aid of a lock. Alternatively, the first and second support members are selected from the group consisting of: elongated hollow or solid members, and/or hollow or solid panels.

Another aspect of the invention is a portable skateboard security rack comprising a portable mount base and a pair of spaced apart support members. Each of the support members are attached to the mount base and extend normally away from the base a height dimension at least as great as the largest deck width of any skateboard which the security rack is designed to secure. At least one of the support members has a width dimension smaller than the smallest wheelbase of any skateboard which the security rack is designed to secure. The support members are mounted in parallel to the mounting base a distance apart that is greater than the largest deck thickness of any skateboard which the security rack is designed to secure, a slot therefore being defined between support members for receiving a skateboard.

The support members of the portable skateboard security rack may be formed as elongated, inverted U-shapes each having spaced apart ends and an elongated middle portion therebetween. The base may comprise a pair of spaced apart strips to which opposed ends of the support members attach. In one embodiment, one of the support members has a width dimension larger than the other. Furthermore, more than two support members may be mounted to the base.

The security rack of the present invention provides users of "non-conventional" transportation and/or recreational equipment, such as skateboards, scooters, snowboards, surfboards, etc., an apparatus to secure these types of equipment in public areas.

DESCRIPTION OF THE PREFERRED EMBODIMENTS

The present invention provides an improved security rack for skateboards that is inexpensive to manufacture and simple to install. To secure a skateboard within the security rack, some type of lock is necessary. A "lock" in the present application refers to any device which can bridge and close a gap or space between two support members, either independently or in conjunction with loops, rings, fixed eyelets, etc., coupled to the security rack. A "lock" typically infers security for the user in that he/she alone has the key or combination. Of course, in some situations of enhanced trust the lock per se could be replaced with a closure of some sort such as a pivoting hook and loop arrangement. Therefore, "lock" also encompasses such generic closures. The term "locking structure" encompasses both a "lock" independently, and in conjunction with these other structures. For example, a skateboard may be secured within the security rack of the present invention using a "U-shape lock" made of a hard material, or may be secured using a standard padlock joining two loops or rings. These variations will become more clear below with reference to the drawings and accompanying description.

In its simplest form, a security rack of the present invention comprises a pair of spaced apart support members defining a slot therebetween within which a skateboard can be inserted. A lock or locking structure coupling the two support members across the top of the slot encloses the skateboard therein. The slot has a relatively narrow width that accommodates at least the thickness of the skateboard deck, but is less than the overall height of the skateboard including the wheels. In this manner, the skateboard cannot be pulled laterally from within the slot because of the interference of the skateboard wheels with one of the support members, and cannot be removed by lifting it out of the slot because of the presence of the lock or locking structure across the top of the slot.

A unit of two support members defining one skateboard security rack can be repeated any number of times to provide an array of security racks. Each of the support members can be mounted independently, or one or more can be mounted to a common base. The most conventional usage is to bolt or cast the bases of the support members into a horizontal concrete base surface, although many other variations are contemplated. For example, the skateboard racks can be mounted to a vertical surface with the skateboards hanging with one of their set of wheels resting on one of the support members. Additionally, although the base surface is typically flat, the security racks of the present invention could be mounted to curved or other than flat surfaces. One idea is to provide a carousel arrangement with a circular drum-like base surface having a plurality of security racks mounted therearound. The drum can be rotated to present one or more security racks at the top for easy access.

Figure 1:
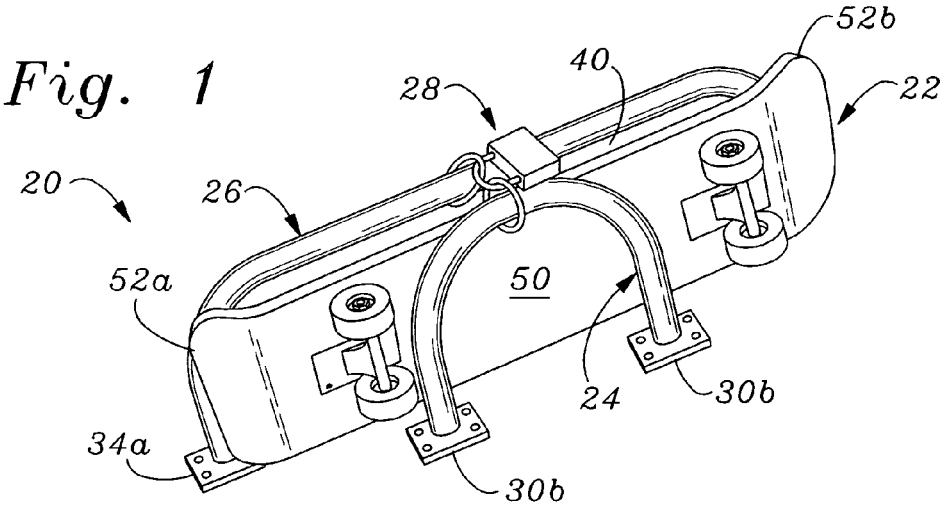
FIG. 1 is a perspective view of an exemplary skateboard security rack of the present invention showing a skateboard secured therein.
Figure 2A:
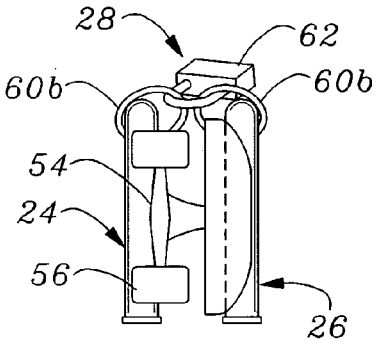
FIGS. 2A and 2B are end and side elevational views, respectively, of the skateboard security rack of FIG. 1 again showing a skateboard therein.
Figure 2B:
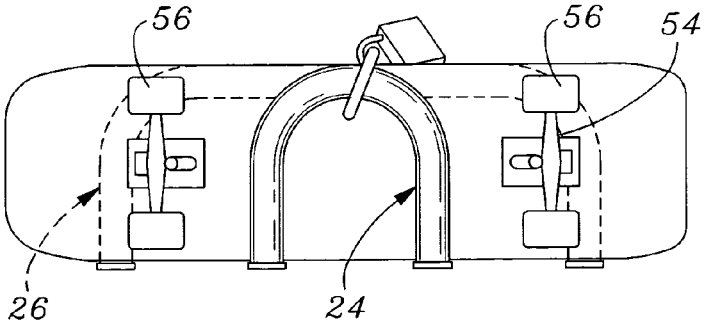

With reference now to FIGS. 1–2B, an exemplary skateboard security rack 20 of the present invention is shown with a skateboard 22 secured therein. In the illustrated embodiment, the security rack 20 comprises a first, smaller support member 24, a second, larger support member 26, and a locking structure 28. Although not shown, the security rack 20 mounts to a base surface such as a horizontal concrete sidewalk.

Figure 3A:
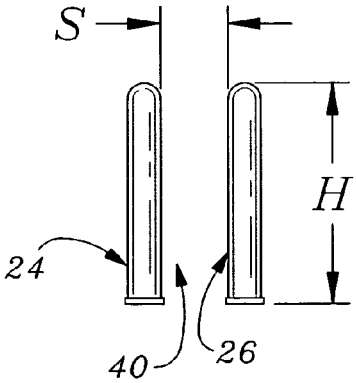
FIGS. 3A and 3B are end and side elevational views, respectively, of the skateboard security rack of FIG. 1 without a skateboard and locking apparatus and indicating several pertinent dimensions.
Figure 3B:
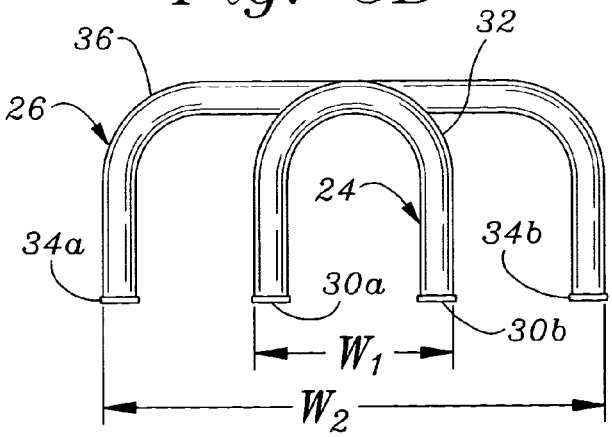

FIGS. 3A and 3B illustrate the security rack 20 minus the skateboard 22 and locking structure 28. The first support member 24 is shaped as an upside-down U-bend with a pair of spaced apart bases 30*a*, 30*b* adapted to mount to the base surface and a middle portion 32 that extends normally away from the bases (and base surface) to a height dimension H. The second support member 26 is also shaped as an upside-down U-bend with a pair of spaced apart bases 34*a*, 34*b* and a portion 36 that extends normally away from the bases (and base surface) to a height dimension H. The first support member 24 has a width $W_1$ while the second support member 26 has a greater width $W_2$. The support members 24, 26 each define respective planes and are mounted generally in parallel with respect to one another so as to form a slot 40 therebetween having a dimension S as shown in FIG. 3A. Those of skill in the art will understand that to function properly the support members 24, 26 need not be planar nor need they necessarily be mounted in parallel.

In a preferred embodiment, the support members 24, 26 are elongated members formed or cast into their respective shapes as shown. Of course, other constructions may be utilized such as non-circular hollow cross-sections, solid cross-sections, or even hollow or solid panel-like members, for example, the inverted U-shaped space within each of the support members 24, 26 may be eliminated if a solid panel having the same exterior periphery is used. Indeed, the support members 24, 26 may even be cast in concrete, in which case the locking structure 28 might include cast in place rings or eyelets.

The support members 24, 26 may be made of a variety of materials that are strong enough to withstand intentional vandalism and will withstand the elements. For example, durable materials that may be used include various metals such as lead, steel, stainless-steel, chrome-molybdenum alloys, aluminum, titanium, etc. Cast concrete may also be used, as well as various plastics, carbon fiber materials, Kevlar, etc. a preferred embodiment is to bend round steel tubing into the inverted U shapes shown and attach flat steel plates to the ends for bases.

In a particularly preferred configuration, the support members 24, 26 are stainless steel tubes having an OD of 1.5 inches. The tubing is 304 metal, A554 quality, with a wall thickness of 0.49 inches. Straight tubing is bent into the shapes as shown. The smaller first support member 24 has its ends spaced apart center-to-center between 9.5–11.5 inches, and has a height of approximately 10 inches. The larger second support member 26 has its ends spaced apart center-to-center between 19.5–21.5 inches, and desirably has the same height as the first support member 24, approximately 10 inches. The bases 30*a,* 30*b* and 34*a,* 34*b* are desirably 2 in. square, ⅛ in. thick flat plate of the same material as the support members 24, 26. The tubing is desirably TIG welded to the bases.

The bases 30*a,* 30*b* and 34*a,* 34*b* made be provided with four through holes as shown for mounted vaults, or only two. Depending on the base surface, the mounting bolts are conventional concrete anchors or other such mounting hardware, though the heads should be tamper-proof. In an alternative configuration, the bases are configured to be embedded within wet concrete, thus eliminating the need for bolts. In this embodiment, the bases are typically provided with a serrated or flanged anchor pylon, not shown. Various other mounting arrangements are possible within the scope of present invention, and will not be further described herein.

FIGS. 1 and 2*a*–2*b* illustrate the skateboard 22 positioned within the slot 40. Per convention, the skateboard 22 includes a generally planar deck 50 having one or both ends 52*a,* 52*b* curled upward. So-called trucks 54 having axles therein bolt to the underside of the deck 50 and support wheels 56 for rotation thereon. The wheelbase of the skateboard 22 is defined as the distance between the pair of wheels 56 on the front-end and the pair of wheels on the rear end of the deck 50. The width $W_1$ of the first support member 24 is smaller than the smallest wheelbase of any skateboard which the security rack 20 is designed to secure. In this manner, as seen in FIGS. 1 and 2B, the two pairs of wheels are located on both sides of the first support member 24. Additionally, the dimension S of the slot 40 is greater than the thickness of the deck 50 but less than the height dimension of the skateboard 22 from the top of the deck at the wheels 56 to the bottom of the wheels. Desirably, the dimension S of the slot 40 is at least 1.5 inches, and preferably between approximately 2.25 and 2.75 inches.

Therefore, as seen in FIG. 2A, the wheels 56 and/or trucks 54 are located on either side of the first support member 24 when a skateboard 22 is position within the slot 40. This arrangement means that the wheels 56 and/or trucks 54 interfere with the first support member 24 if someone attempts to pull the skateboard 22 laterally from within the slot 40. In other words, once the skateboard 22 is within the slot 40, the only way to remove it is by lifting it upward out of the slot, which of course is prevented by the locking structure 28.

FIG. 2A illustrates one arrangement of locking structure 28 comprising a pair of loops 60*a,* 60*b* coupled to the support members 24, 26 and an independent lock 62 joining the loops. The lock 62 is shown as a conventional padlock, but could be any variety of off-the-shelf lock. The loops 60*a,* 60*b* freely slide on the elongated upside-bend U-bend support members 24, 26, and are shown as circular rings, but could take other forms, such as oval or square. Furthermore, the loops 60*a,* 60*b* could be provided as fixed eyelets or other such loop structure at the midpoint of each support member 24, 26. The free-sliding loops 60*a,* 60*b* are preferable to reduce the cost of the security rack 20. Of course, the loops 60*a,* 60*b* are made of a high strength material comparable to the material of the lock 62 to prevent theft.

It should also be understood, as mentioned above, that a single independent lock 62 that can span the slot 40 may also be used in place of the combined loops 60*a,* 60*b* and lock 62. For example, an elongated U-shape lock may be used to extend between the support member 24, 26, spanning the slot 40. The height H of the support members 24, 26 may have to be increased to accommodate such independent locking structure. That is, a U-shape lock could not pass between the uppermost portion of the support members 24, 26 shown because of the presence of the deck 50 of the skateboard 22, as seen best in FIG. 2B. This is another advantage of providing either fixed or freely slideable loops 60*a,* 60*b,* as the height H of the support members 24, 26 need only be approximately as great as the largest deck width of any skateboard which the security rack is designed to secure, thus reducing material costs and space requirements. Cable locks could be used, though longer ones would provide too much freedom of movement to the skateboard and would not effectively constrain it within the slot 40.

As mentioned above, a single security rack unit includes two support members and locking structure for securing a skateboard therebetween. In the embodiment illustrated in FIGS. 1–3B, the support members 24, 26 are differently sized. That is, at least one of the support members, in this case the smaller support member 24, has a width smaller than the smallest wheelbase of any skateboard that the security rack 22 is designed to secure. The larger support member 26 may have the same width, or may be sized larger as shown. The main advantage of providing a longer support member 26 is that it protects the opposed ends of the skateboard from damage. That is, without such protection the ends of the skateboard 22 may be kicked or step on. Furthermore, the longer support member 26 provides some additional security in preventing theft of the skateboard. A thief trying to prise the skateboard 22 from within the slot 40 cannot angle it out of the plane of the slot because of the abutting ends of the large support member 26. However, even with two shorter support members, the width of the slot 40 may be made sufficiently small to prevent any such angling. Indeed, in a minimal sense, two linear posts spaced apart and provided with locking structure over the top may function as the support members of the present invention and secure a skateboard therebetween.

Figure 4:
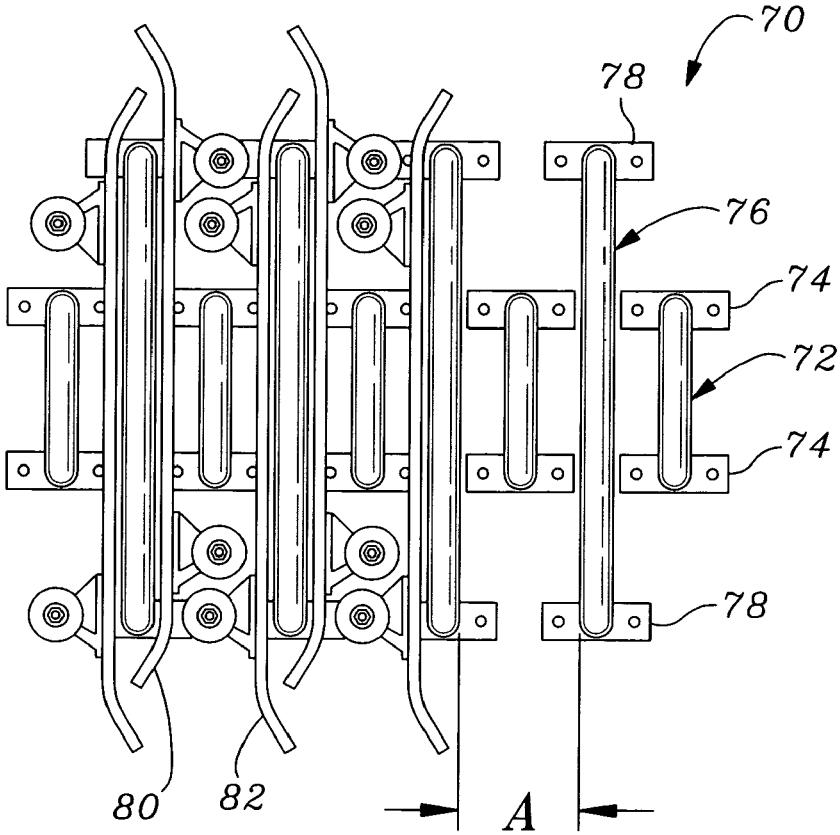
FIG. 4 is a top plan view of a series of alternating long and short spaced apart support members defining slots therebetween and forming an array of skateboard security racks of the present invention.

FIG. 4 illustrates an array 70 of skateboard security racks of the present invention comprising a plurality of alternating short and long support members. More specifically, a plurality of shorter first support members 72 each having bases 74 thereon are mounted in parallel and aligned with one another. In between each two of the first support members 72, a second support member 76 having bases 78 thereon is mounted. Again, the second support members 76 are mounted in parallel and aligned with one another, and in parallel and aligned with the first support members 72. Each of the first support members 72 has a width that is smaller than the smallest wheelbase of the skateboard that the security rack array 70 is designed to secure. Furthermore, a pair of skateboards, such as first and second skateboards 80, 82, may be secured in adjacent slots on either side of one of the first support members 72. In such an arrangement, the width of the first support members 72 must be somewhat smaller than the smallest wheelbase of the skateboards 80, 82 to accommodate the overlapping wheels. By alternating the short and long support members 72, 76 as shown, the number of skateboards that can be secured within the array 70 is almost doubled relative to the number of skateboards that could be secured within the same number of pairs of short and long support members. The dimension A between two of the longer support member 76 is indicated and should be between approximately 6.25 and 6.75 inches to accommodate two skateboards therebetween.

Figure 5:
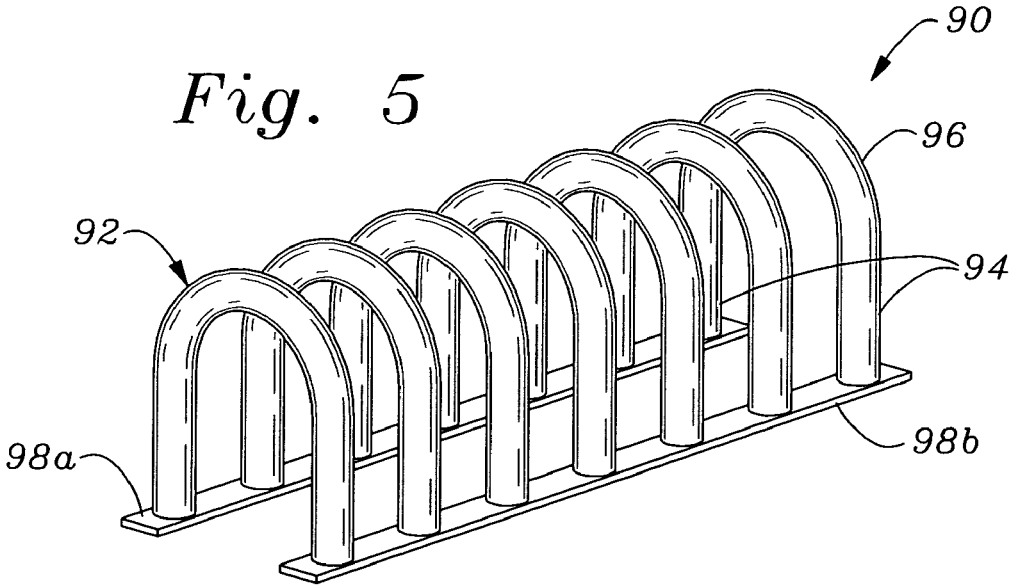
FIG. 5 is a perspective view of an array of the same sized support members defining slots therebetween and mounted on a common base to form a portable, modular structure.

FIG. 5 illustrates a security rack array 90 having a plurality of identical support members 92 mounted on a common base. In the illustrated embodiment, the support members 92 are elongated inverted U-shapes having spaced apart ends 94 and upstanding middle portions 96, and a first common base 98*a* and a second common base 98*b* are used to couple the ends on either side of the array. The entire array 90 can therefore be transported and mounted as a unit without necessity of alignment of individual support members.

Figure 6A:
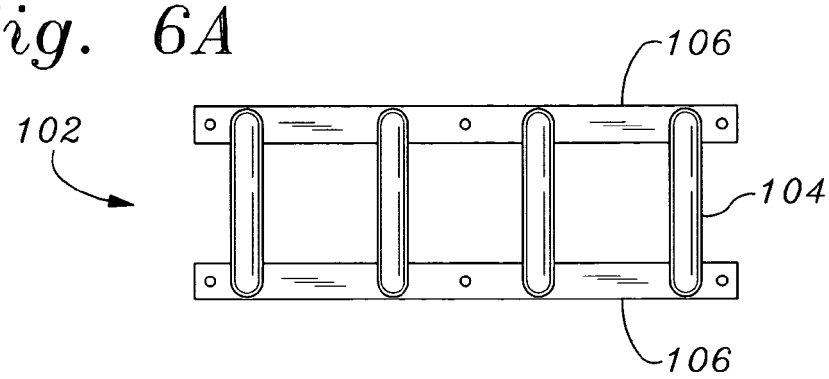
FIGS. 6A and 6B are top plan views of a pair of cooperating modular structures, one having a series of short support members thereon and the other having a series of long support members thereon.
Figure 6B:
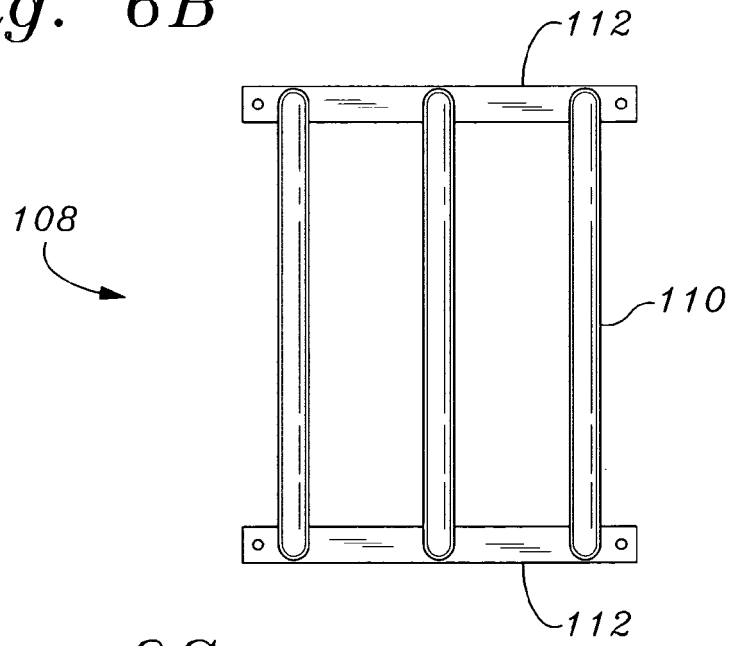
Figure 6C:
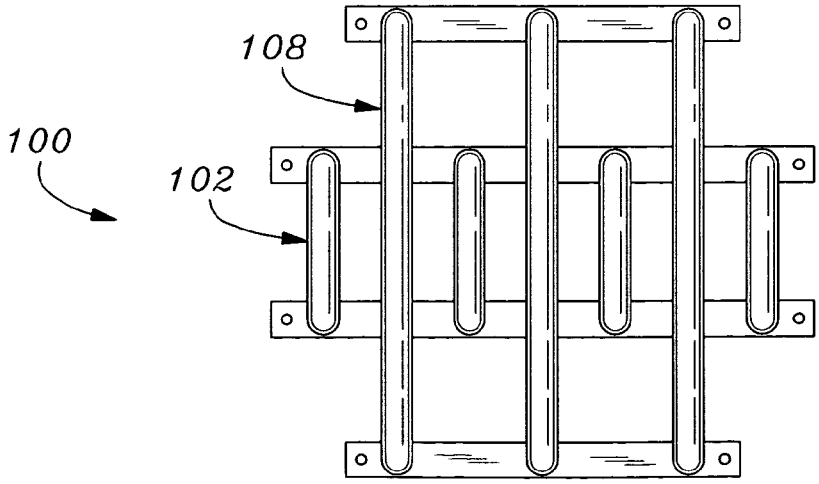
FIG. 6C is a top plan view of the combined modular structures of FIGS. 6A and 6B together forming an array of slots for receiving and securing skateboards therein.

FIGS. 6A–6C illustrate a still further security rack array 100 which takes advantage of the common base concept shown in FIG. 5 as well as having alternating short and long support members. FIG. 6A shows a small support member array 102 having a plurality of small support members 104 with their respective ends mounted to common bases 106. FIG. 6B shows a large support member array 108 having a plurality of large support members 110 with their respective ends mounted to common bases 112. FIG. 6C shows the assembly of the small support member array 102 and large support member array 108 forming the security rack array 100. Of course, the respective bases 106, 112 must be aligned and spaced apart the proper distance to form the array 100. In the illustrated embodiment, there are four short support members 104 and three long support members 110 together providing slots for securing six skateboards.

While the foregoing describes the preferred embodiments of the invention, various alternatives, modifications, and equivalents may be used. Moreover, it will be obvious that certain other modifications may be practiced within the scope of the appended claims.

What is claimed is:

1. A skateboard security rack for securing a skateboard having a deck and a pair of axles mounted thereon with wheels, the skateboard having a wheelbase, a deck thickness, a deck width, and a height from the top of the deck at the wheels to the bottom of the wheels, comprising:

a pair of spaced apart support members each having a base adapted to mount to a base surface and a portion that extends normally away from the base to a height dimension at least as great as the skateboard deck width, a first one of the support members having a maximum width dimension smaller than the skateboard wheelbase, the support members being adapted to mount in parallel to one another at a distance apart perpendicular to the support member width dimension that is greater than the skateboard deck thickness but less than the skateboard height, a slot therefore being defined between the support members for receiving a skateboard; and locking structure including loops coupled to both support members wherein a lock is used to join the loops together for constraining a skateboard positioned in the slot and having its wheels on both sides of the first support member.

2. The skateboard security rack of claim 1, wherein the loops are movable on at least one support member.

3. The skateboard security rack of claim 2, wherein the loops slide freely on at least one support member.

4. The skateboard security rack of claim 1, wherein both loops are provided in a fixed position on each respective support member.

5. The skateboard security rack of claim 1, wherein the support members are selected from the group consisting of:

elongated hollow members;

elongated solid members;

hollow panels; and solid panels.

6. The skateboard security rack of claim 1, wherein the support members are configured as elongated upside-down U-bends.

7. The skateboard security rack of claim 6, wherein each upside-down U-bend defines a pair of spaced apart bases and a middle portion that extends normally away from the bases to the height dimension such that the apex of the U-bend is farthest away from the bases.

8. The skateboard security rack of claim 6, wherein each upside-down U-bend comprises a hollow tube, and wherein the locking structure includes free-sliding loops on both support members.

9. A skateboard security rack for securing a skateboard having a deck and a pair of axles mounted thereon with wheels, the skateboard having a wheelbase, a deck thickness, a deck width, and a height from the top of the deck at the wheels to the bottom of the wheels, comprising:

a pair of spaced apart support members configured as elongated upside-down U-bends each having a base adapted to mount to a base surface and a portion that extends normally away from the base to a height dimension at least as great as the skateboard deck width, a first one of the support members having a maximum width dimension smaller than the skateboard wheelbase, the support members being adapted to mount in parallel to one another at a distance apart perpendicular to their width dimensions that is greater than the skateboard deck thickness but less than the skateboard height, a slot therefore being defined between the support members for receiving a skateboard; and locking structure coupled to both support members for constraining a skateboard positioned in the slot and having its wheels on both sides of the first support member.

10. The skateboard security rack of claim 9, wherein each upside-down U-bend defines a pair of spaced apart bases and a middle portion that extends normally away from the bases to the height dimension such that the apex of the U-bend is farthest away from the bases.

11. The skateboard security rack of claim 9, wherein the support members are selected from the group consisting of:

elongated hollow members; and elongated solid members.

12. The skateboard security rack of claim 9, further including a portable mounting base to which the bases of each of the support members attach.

* * * * *